US007210670B2

(12) United States Patent
Franks

(10) Patent No.: US 7,210,670 B2
(45) Date of Patent: May 1, 2007

(54) DRAWWORKS APPARATUS

(76) Inventor: Charles Gllen Franks, 1406 8th St., Unit No. 56, Canyon, TX (US) 79015

( * ) Notice: Subject to any disclaimer, the term of this patent is extended or adjusted under 35 U.S.C. 154(b) by 422 days.

(21) Appl. No.: 10/866,803

(22) Filed: Jun. 15, 2004

(65) Prior Publication Data

US 2005/0006633 A1 Jan. 13, 2005

Related U.S. Application Data

(60) Provisional application No. 60/483,469, filed on Jun. 30, 2003.

(51) Int. Cl.
*B66D 1/14* (2006.01)

(52) U.S. Cl. ..... 254/294; 254/278; 254/322

(58) Field of Classification Search ..... 254/294, 254/312, 322, 278
See application file for complete search history.

(56) References Cited

U.S. PATENT DOCUMENTS 3,467,360 A 9/1969 Mizell
3,614,066 A * 10/1971 Day ..... 254/299
3,738,614 A * 6/1973 Peterson ..... 254/358
4,192,485 A * 3/1980 Rassieur et al. ..... 254/322
4,226,311 A 10/1980 Johnson et al.
4,438,904 A 3/1984 White
4,696,377 A * 9/1987 Richardson et al. ..... 188/170
4,842,250 A 6/1989 Willis et al.
6,182,945 B1 2/2001 Dyer et al.

* cited by examiner

*Primary Examiner*—Emmanuel M Marcelo
(74) *Attorney, Agent, or Firm*—Todd A. Vaughn

(57) ABSTRACT

A drawworks having a main drum spool, a main drum shaft which passes through and is rotatably and concentrically supported by the main drum spool, an auxiliary drum spool, respective drum shafts passing through and rotatably and concentrically supported by the drum spools in a manner in which wireline pull from the spools is isolated therefrom, a clutch mechanism rotatably connected to the shafts and brake mechanisms respectively connected to the main drum spool and the auxiliary drum spool outside the working area of the drawworks.

20 Claims, 5 Drawing Sheets

DRAWWORKS APPARATUS

CROSS-REFERENCE TO RELATED APPLICATIONS

This application claims the benefit of U.S. Provisional Application Ser. No. 60/483,469, filed Jun. 30, 2003.

BACKGROUND OF THE INVENTION

1. Field of the Invention

The invention relates generally to a drawworks apparatus having a drive mechanism and a brake mechanism that are positioned externally relative to the operating area of the drawworks frame and a shaft which is isolated from wireline pull generated during operation of the drum spool.

2. Description of the Related Art

The drawworks is a type of winch used in the oil well drilling and service industry as a portion of a drilling or servicing rig to raise and/or lower items such as tools and lengths of pipe from a well bore from which oil or other hydrocarbons are produced.

The drawworks typically includes a large-diameter spool that typically supports a length of cable, one or more brakes, a drive system connecting the spool to a power source, and other auxiliary devices that may assist in the lowering and raising items into a well bore.

However, major disadvantages plague conventional drawworks designs: for instance, a major portion of the cost of manufacturing a conventional drawworks is due to the complexity of its design.

Also, a significant portion of the cost of operating a well servicing or drilling rig is maintenance. The maintenance cost is influenced greatly by the number of components requiring servicing and their accessibility.

Moreover, drumshaft failures cause the loss of braking ability in conventional drawworks and are much more likely to occur in a conventional drawworks due to the fact that it carries the line pull and must also absorb shock loads transmitted through the wire line spool.

Still another common problem with conventional drawworks is the pliability of the brake bands. The pliable nature of the brake bands is often caused by insufficient anchoring of the dead end of the brake band.

Yet and still another problem in conventional drawworks designs occurs at the brake live end, particularly, as the brake blocks wear, the brake band wraps further around the brake flange to allow the brake live end linkage to break over center and unexpectedly release the brakes.

It is still another problem with conventional drawworks designs of experiencing failure due to contamination of the clutches' frictional surfaces with oil or other foreign debris and materials. This problem is also associated with the conventional internal mounting of the brakes and other components within the drawworks frame.

An additional problem associated with conventional drawworks the use of various types of seals, usually in the form of some type of labyrinth, to prevent oil from traveling to the clutch. This is not a very reliable technique and results in many drawworks failures.

Yet and still a further problem associated with conventional drawworks apparatus is the fact that the wire line clamp is virtually hidden by the brake flange, the drawworks frame and guards, or the wear plates placed on the inside surface of the drum end.

SUMMARY OF THE INVENTION

It is one aspect of the invention to provide a drawworks apparatus that reduces the complexity in conventional drawworks design without sacrificing performance, versatility or durability. The reduction of design complexity is accomplished by eliminating parts, which is made possible by a novel arrangement of drawworks components.

It is another aspect of the invention to provide a drawworks apparatus in which those components that have been traditionally shown of frequent servicing more accessible by locating them outside of the drawworks frame. For instance, the drawworks apparatus in accordance with the invention provides a novel location for connecting the wire line spool to the drawworks frame via a set of bearings, thereby making it possible to locate the brakes externally, i.e., outside the drawworks frame and the working or operating area of the drawworks wherein the raising and lowering of equipment occurs. Two resulting benefits of arranging the brakes outside the drawworks frame are cooler running brakes and easier maintenance of the brakes. The bearings provided to connect the wire line spool to the drawworks frame are selected on the basis of size and not according to load capacity. Consequently, the fatigue-life rating greatly exceeds the life expectancy of the rest of the rig. Another advantage of locating the bearings for connecting the wire line spool to the drawworks frame in such a manner is that it removes the wire line pull from the drumshaft of the main drum spool and the sand drum spool, thereby reducing its required size and strength as well as improving its reliability.

It is still another aspect of the invention to provide a drawworks apparatus that continues to provide braking function even in the event of drumshaft failure. This is a result of positioning the drumshafts relative their respective main drum spool and sand drum spool in a manner in which they are only required to carry chain pull, the weight of relatively light-weight components, and the torsional loads need to rotate the spools. This novel arrangement prevents the loss of braking capacity in the event of a drumshaft failure.

Yet and still another aspect of the invention is to provide a drawworks apparatus that uses a novel design of dead-end components in a brake system that permits the use of many common components on various sizes of drawworks while utilizing the basic drawworks design. Among the common components are such major items as the drawworks frame, brake beam, bell cranks and an equalizer screw. This is either impossible or impractical for conventional drawworks designs. Thus, the cost of producing a particular piece of machinery can be reduced by using as many common components as possible and also by using components of other similar equipment.

Still a further aspect of the invention is to provide a drawworks apparatus which eliminates the need for outside equipment such as cranes, gin pole trucks, and heating devices to conduct field repairs and maintenance. The use of such equipment is common for conventional drilling and well servicing rigs. For example, hubs are commonly shrink or press fitted the drive spool drum shafts on which they are mounted, and thus, heating devices such as torches are required to remove them. Because the drive system and the brake assembly of the drawworks apparatus in accordance with the invention are located outside of the working area of the drawworks frame, the drawworks components may be arranged and sized in such a manner that they can be disassembled and reassembled by hand without having to pull hubs from the drive spool drum shafts using outside equipment such as heating devices.

It is still another aspect of the invention to provide a drawworks apparatus having an arrangement of working components that positions the crutches and the brakes outside both the drawworks frame, i.e., the working or operating area, and the chain drive cases. While some conventional drawworks designs locate the clutch outside the drawworks frame and the chain case, it is not physically separated from the chain case. The external mounting of the clutches and brakes in the drawworks apparatus of the invention reduces the likelihood of failure due to contamination of the clutches' frictional surfaces with oil or other foreign debris and materials. Since the clutches and brakes are used to control the raising and lowering of very heavy loads on the rig, any failure of these devices could have disastrous consequences.

Yet and still an additional aspect of the invention is to provide a drawworks apparatus that positions the brakes, flanges and the clutch relative to the drawworks frame that permits ease in inspection and servicing of the wire line clamp located at the drum end side of the wire line spool. Experienced professionals in the operation of oil well drilling and well drilling and servicing rigs find it absolutely essential to keep the wire line clamp properly tightened at all times, therefore, easy accessibility is very desirable. Therefore, unlike conventional drawworks designs, there are no such obstructions on the drawworks of the present invention.

The novel configuration of the drum spool allows the drumshaft bearings to be located very close to the only applied radial loads, keeping the applied bending moments to a minimum for a given chain pull. This condition permits the user of a smaller, light-weight drumshaft that would be otherwise possible, and at the same time maintains a high factor of reliability.

The novel placement of the brake flange facilitates the design of a very narrow, lightweight drawworks frame. The drawworks frame in accordance with the invention may be sized sufficiently narrow so that its side panels can be attached (via a welding operation) directly to the main structural members of the carrier or trailer upon which it is mounted. The relatively large weld length afforded in this design significantly reduces to a low level the weld stresses at the point of the drawworks attachment, thereby enhancing the reliability of the weld. Moreover, since the drawworks requires no gusseting for attachment to the carrier frame, both costs and complexity in design are reduced. Accordingly, the direct attachment of the drawworks side plate to the carrier frame increases the strength and rigidity of both members.

The drawworks apparatus in accordance with the invention also utilizes a strong structural member called a brake beam in which to anchor the brake band. This member is sized for a minimum deflection that yields an extremely strong member. A contributing factor in the pliable brake band used in conventional drawworks designs is the eccentric force exerted on the dead end of the brake brand. Besides being too pliable, conventional brake bands are prone to lift upwardly relative to the flange surface. This problem is cured in the drawworks apparatus of the invention by anchoring the brake bands using a component(s) that exerts a tangential pull on the brake band.

The drawworks apparatus in accordance with the invention utilizes a novel feature of a dead end equalizer by incorporating a threaded trunnion block for removing the bending moment form the trunnion pin located in the bell crank. Conventional drawworks designs threads the equalizer screw through a threaded hole in the trunnion pin which absorbs the axial load placed on the equalizer screw when the brakes are applied. The drawworks apparatus of the invention utilizes a trunnion pin with a drilled rather than threaded hole through which the equilizer screw passes. This is advantageous since the trunnion pin is placed in a shear-loaded condition, essentially eliminating any bending loads. In the conventional design, the trunnion pin is strong in shear but relatively weak in bending due to both the moment arm of the applied load and the loss of material caused by the hole through which the equalizer screw passes.

Unlike conventional designs, the drawworks apparatus in accordance with the invention includes a linkage system that does not permit the brake shaft to rotate over center. Such a feature is very important to crew safety since the correction of the condition on a conventional rig requires a crew member to place himself virtually inside the drawworks, where the slightest error can have fatal results. The load may drop out of control when the brakes pass over center if the operator fails to catch the load with the slips.

These and other objects, features and advantages of the invention will become more apparent from the following description when taken in conjunction with the detailed drawings that show, for purposes of illustration only, the preferred embodiments of the invention.

BRIEF DESCRIPTION OF THE DRAWINGS

The advantages of the invention will become more apparent to those skilled in the art in conjunction with the detailed description of the preferred embodiments of the invention, in which.

DETAILED DESCRIPTION OF THE INVENTION

Figure 1:
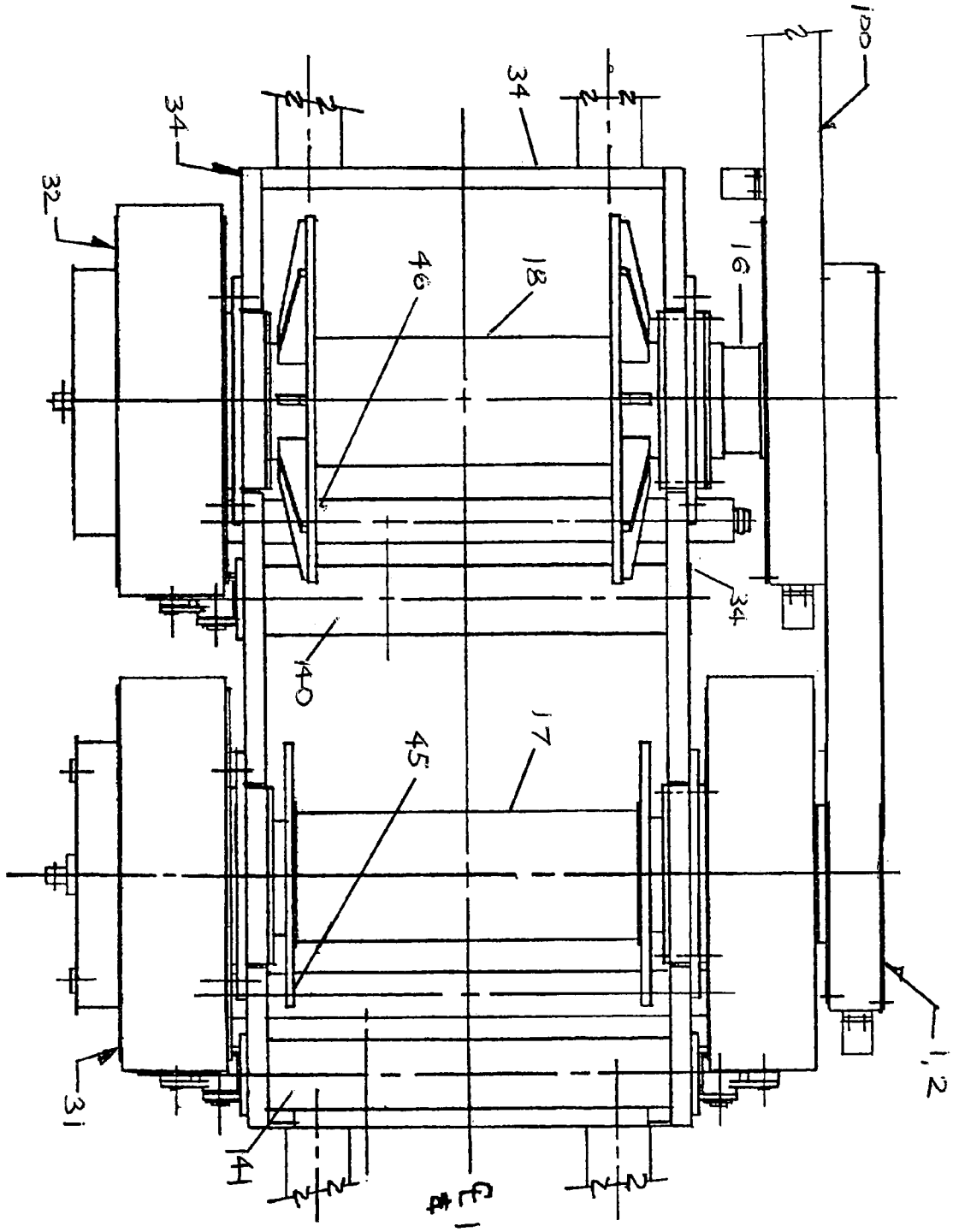
FIG. 1 is a top plan of the drawworks apparatus in accordance with the invention.

Referring now to drawing FIGS. 1–5, which show in detail a winch or power transmission apparatus, commonly called a drawworks, including drawworks frame 34, main drum spool 17 and auxiliary or sand drum spool 18 in substantially parallel relation to main drum spool 17. Also provided is a suitable drive device and a brake assembly 31, 32 for main drum spool 17 and sand drum spool 18. By way of suitable bearings 14, main drum spool 17 and sand drum spool 18 are directly attached to the drawworks frame 34. Particularly, main drum spool 17 is supported for rotation on drawworks frame 34 via bearings 14 while sand drum spool 18 is supported for rotation on drawworks frame 34 via bearings 14.

Central shaft 15 of main drum spool and central shaft shaft 16 of sand drum spool 18 are concentric with their respective drum spool 17, 18 and extend longitudinally outward through respective shaft bores of the spools 17, 18. Shafts 15, 16 are rotatably mounted preferably via anti-friction bearings 13 at each end of its respective drum spool 17, 18. Thus, main drum spool 17 and sand drum spool 18 are supported by frame 34, and main drum shaft 15 is supported by main drum spool 17 and sand drum shaft 16 is supported by sand drum spool 18. Accordingly, by arranging main drum spool 17 and sand drum spool 18 to support their respective drum shafts 15, 16, any applied radial loads are transmitted back to drawworks frame 34. In a manner that will be explained hereafter, the structural configuration and relationship between shafts 15, 16, drum spools 17, 18 and frame 34 is advantageous since the braking ability of the drawworks is unaffected by any failure to drum shafts 15, 16 during hoisting operation.

Figure 2:
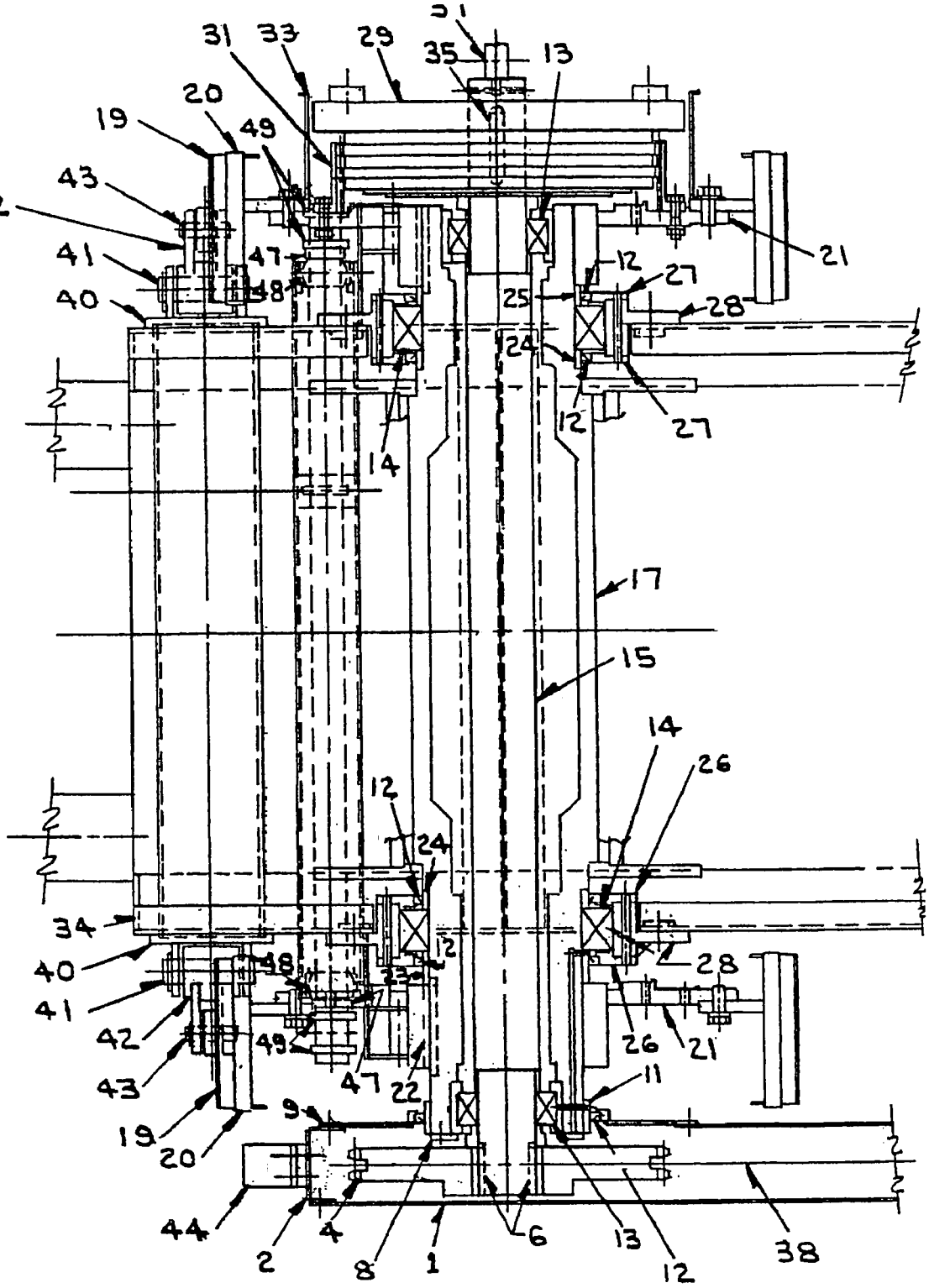
FIG. 2 is a top cross-sectional view of the main drum section of the drawworks apparatus.

As shown in FIG. 2, a suitable drive device 1, 2 is provided for driving main drum spool 17 and sand drum spool 18. A driving source (not shown) is connected to transmission chain 100 which is in turn connected via sprocket 5 mounted to sand drum shaft 16. Drumshaft 15 for main drum spool 17 supports clutch 29 on one end and sprocket 4 on the other end. Thus, the torque necessary to rotate main drum spool 17 is input through sprocket 4. The torque is transmitted through key 35 loaded in shear to drumshaft 15, and from there the torque is transmitted through another key 6 to the hub of friction clutch 29. Upon any application of air pressure, the torque is transmitted through clutch drive ring 31 to spider 29 mounted on the drum spool extension. Spider 21 is also the component to which one of the brake flanges 20 is mounted. The torque applied to sprocket 4 which is mounted on the end of the main drum drumshaft 15 is transmitted to sprocket 4 by way of chain drive system 1, 2, whereby driver sprocket 5 of which is located on the end of sand drum drumshaft 16. During the time that the main drum spool 17 is in operation, sand drum drumshaft 16 functions as a jackshaft, i.e., it functions as an intermediate shaft between the prime mover and the driven shaft (in this case, main drum drumshaft 15). It should be understood by those of ordinary skill that any conventional driving device known in the art may be used to drive both main drum spool 17 and sand drum spool 18.

The drawworks of the invention is provided with a brake assembly 31, 32 for controlling the rotation of each drum spool 17, 18 during the operation of the drawworks apparatus, i.e., when cable is being payed out to lower items. The respective brake assemblies 31, 32 for main drum spool 17 and sand drum spool 18 includes brake shaft 45 for main drum spool 17 and brake shaft 46 for sand drum spool 18, each brake shaft 45, 46 being rotatably mounted within a shaft bore to drawworks frame 34. Main drum spool 17 is provided with a pair of brakes located at each end of frame 34 while sand drum spool 18 is provided with a single brake located opposite drive system.

Brake flanges 20 are mounted to each drum spool 17, 18 on an extended portion of each respective drum spool 17, 18. The mounting of the brake flanges 20 is accomplished through the use of spider 21 with a keyed hub 22. The main drum spool 17 has two brake flanges 20 mounted on it, and are positioned externally relative to the drawworks frame 34. Sand drum spool 18 has a single brake flange 20 that is also mounted externally relative to the drawworks frame 34. Anti-friction bearings 13 are mounted within the bore of each drum spool 17, 18 to support a respective drumshaft 15, 16 in a manner which does not restrict rotation of the shafts 15, 16. This produces what is commonly known as a "live shaft." Accordingly, the braking ability of the drawworks apparatus is unaffected by any failure to shafts 15, 16 because the brake assemblies 31, 32 are structurally connected directly to drum spools 17, 18 instead of to shafts 15, 16 (i.e., shafts 15, 16 are structurally isolated from the brake assembly). While the sand drum spool 18 has one brake flange 20 mounted on it in accordance with this aspect of the invention, it could have two brake flanges 20 attached to it.

Figure 3:
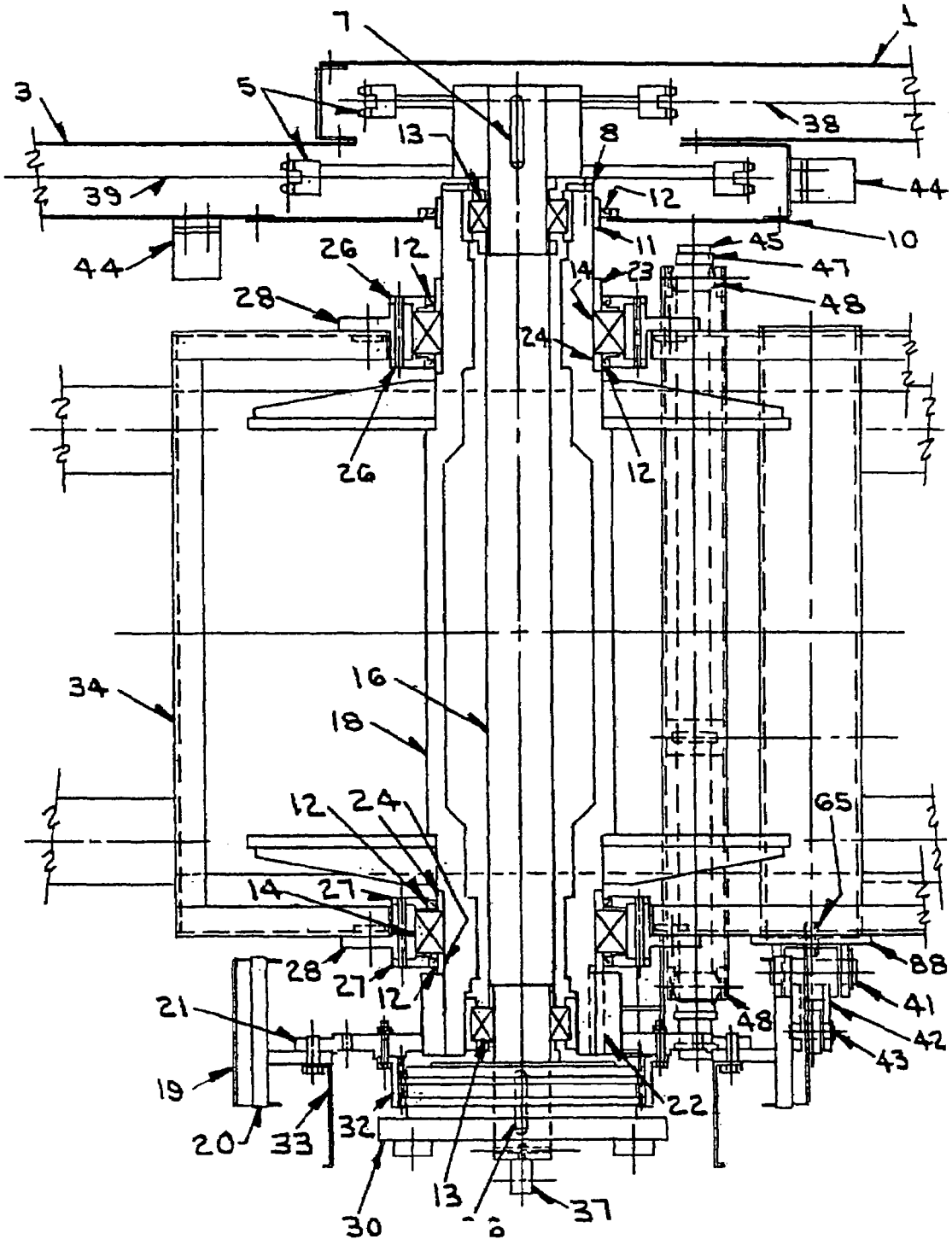
FIG. 3 is a top cross-sectional view of the sand drum section of the drawworks apparatus.

As shown in FIG. 3, the sand drum drumshaft 16 at one end is rotatably connected to sprocket 5 having two sets of sprocket teeth attached to it by way of a keyed hub 7. The opposite end of sand drum drumshaft 16 is rotatably connected to clutch 30 mounted via key 36. The torque necessary to rotate the sand drum spool 18 is input through sprocket 5 mounted on sand drum drumshaft 16, and is transmitted through key 36 which is loaded in shear to sand drum drumshaft 16. From there the torque is transmitted through key 7 loaded in shear to the hub of clutch 30, and upon application of air pressure, the torque is transmitted through clutch drive ring 32 to spider 21 mounted on an extension to sand drum spool 18. Spider 21 is also the component to which brake flange 20 for sand drum spool 18 is mounted.

The torque applied to sprocket 5 which is mounted to one end of sand drum drumshaft 16 is transmitted thereto by way of chain drive system 1, 2 and 3. Chain drive system 1, 2, and 3 is also available for use in transmitting power to an assist brake, which may be in the form of a band, water or electric brake used to absorb the tremendous energy generated when the drawworks apparatus is engaged in an operation of lowering a length of pipe or casing into a well bore.

Figures 4A, 4B:
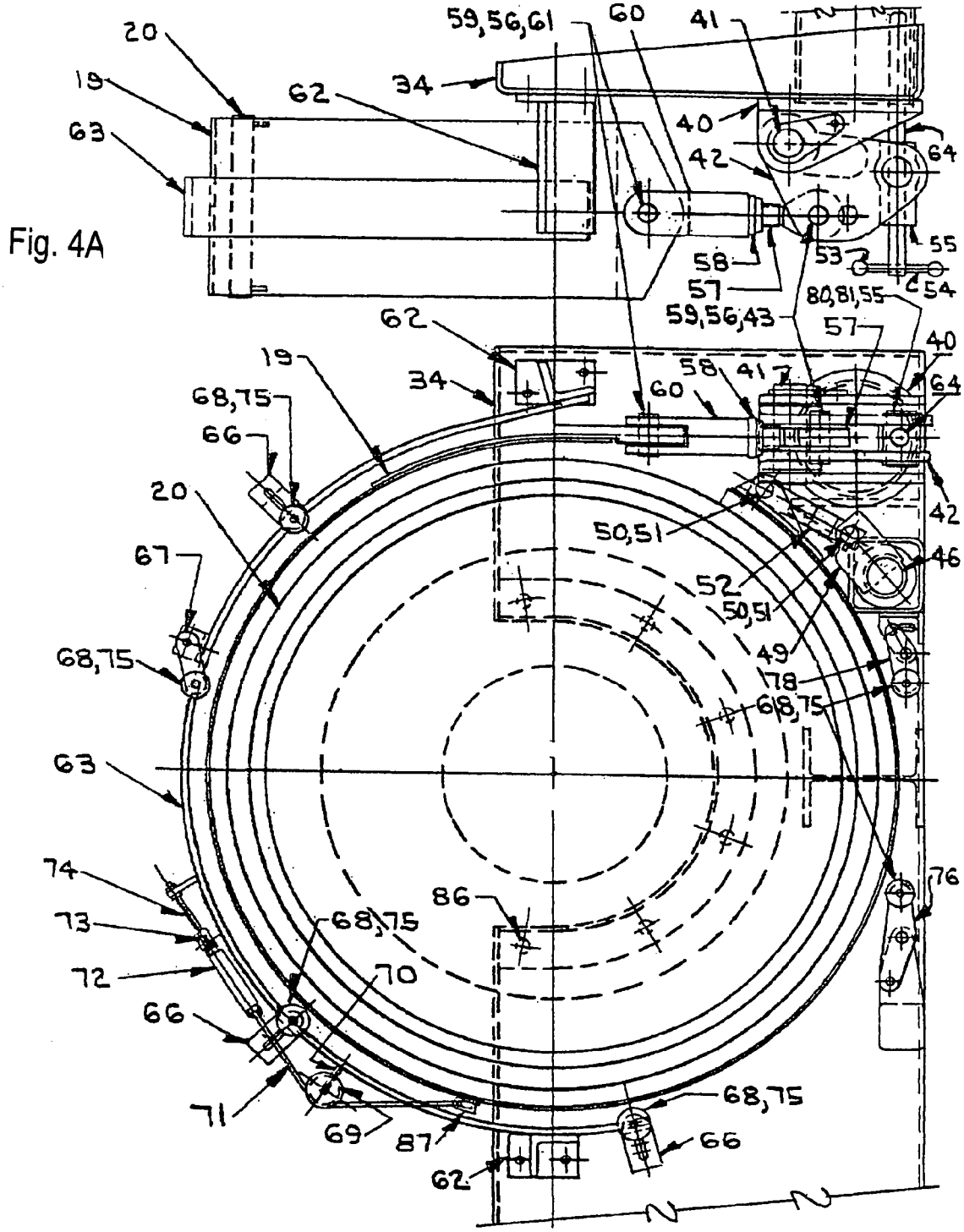
FIGS. 4A and 4B are side and front cross-sectional views of the brake system of the drawworks apparatus.
Figure 5A:
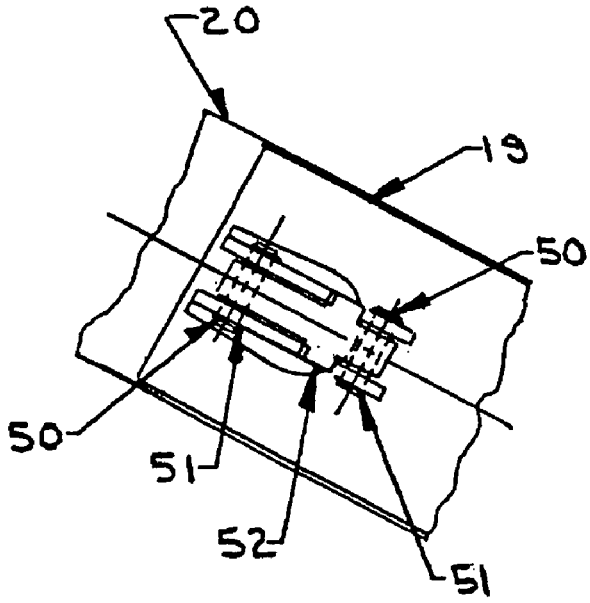
FIGS. 5A–5C are top cross-sectional views of the brake linkage assemblies of the drawworks apparatus.
Figure 5B:
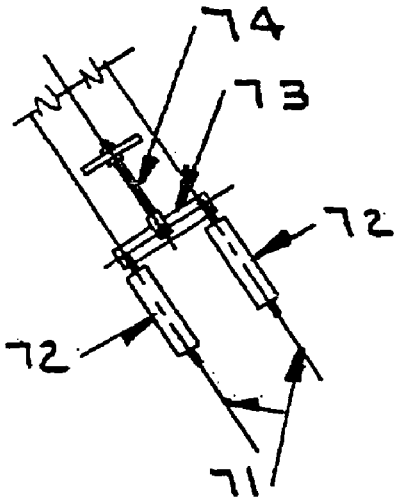
Figure 5C:
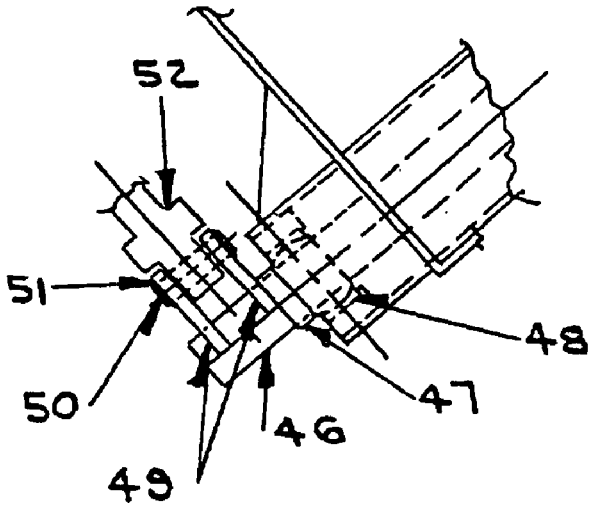

As illustrated in FIGS. 4A and 4B, the drawworks in accordance with the invention utilizes band brake 19 having at least one brake blocks for reducing the speed of rotation of both main drum spool 17 and sand drum spool 18 so as to control the rate at which the length of cable from drum spools 17, 18 are payed out. As also shown in FIGS. 5A–5C, band brake 19 is mounted at a "live end" thereof via a first linkage system which includes ears 49, pin 50, retaining ring 51, link 52, to brake shaft 46 and at the "dead end" via a pivotably adjustable linkage system which includes bell crank 42 and equilizer 64.

Band brake 19 may take the form of a self-energizing actuated by a force applied by the driller or operator to a torque lever or handle (not shown) to tighten brake band 19 and thereby engage the brake blocks mounted to brake band 19 with the surface of the spool 17, 18. Such actuation force may be transmitted using a pivotably adjustable linkage assembly to the "dead end" of brake bands 19. The drawworks apparatus utilizes a tubular member or brake beam 140, 141 that longitudinally extends through drawworks frame 34 and is cantilevered at ends thereof. The brake bream 140, 141 includes a pair of brake beam anchors 40 at each thereof which are welded into drawworks frame 34 to anchor the "dead end" of brake band 19 via a cantilever arrangement. Brake beam 140, 141 is advantageous in that it maintains its strength regardless of the direction of the applied dead end brake force.

For the main drum spool 17, each anchor 40 of brake beam 140 extends past the side plates of drawworks frame 34, and a bell crank 42 is pivotably mounted at each respective end thereof. Preferably, brake beam anchors 40 are not welded until the size of the brake becomes known as it may become necessary to rotate it about its axis to accommodate a specific flange size. Anchors 40 at each end of brake beam 140 have lugs with holes bored therein, and are rotatable to accommodate various sizes of brakes. Thus, the line of force from the dead end of brake band 19 passes through its centerline regardless of the size of brake band 19 without the need for repositioning brake beam 140.

Bell crank 42 which includes a hole bored at its pivot point is placed at the end of each anchor 40 and by way of pivot pin 41 attached thereto. A plurality of holes may be bored at the three locations in the bell crank 42: one at pivot point 41, one at the center of brake flange 20, and one at the center of brake beam anchors 40. Brake bands 19 are pivotably connected through an adjustable linkage to bell crank 42 with a pin hole through the bored holes at the center of the brake flange 20. Substantially spherical bushings (not shown) are used at both ends of linkage to ensure a free, non-binding operation, while equalizer screw 64 connects the bell cranks 42 to the "dead end" of band brakes 19.

The following procedure should be used to install the equalizer screw 64: Firstly, equalizer screw 64 should be inserted longitudinally through brake beam 140 through the hole in each anchor 40. Equalizer screw 64 has left hand threads at one end and right hand threads at the other end; therefore, simply turning the screw 64 will either tighten or loosen the brake linkage. Secondly, before bell cranks 42 are attached to brake beam 140, place threaded trunnion block 55 between the lugs of the bell crank 42, making sure to align it with the trunnion pin holes of the bell crank 42. Thirdly, insert trunnion pin 80 through the bored holes in bell crank 42 and threaded trunnion block 55. Finally, take the three-pieced assembled piece, i.e., bell crank 42, trunnion block 55 and trunnion pin 80, and insert equalizer screw 64 through the hole in trunnion pin 80, then rotate equalizer screw 64 for insertion into trunnion block 55. Continue doing this until pivot pin 41 is installed to join bell crank 42 to each brake beam anchor 40.

The equalizer assembly 64 is provided for main drum spool 17 to ensure that an equal braking force is placed on each brake band 19. The "live end" of brake band 19 is coupled to a rotating brake shaft 46 through a link pin 50 on one end to lugs welded to the brake shaft 46 on the other end. This linkage is similar to a convention design except that link 52 has lugs on its sides that connect bracket ears 49 to brake shaft 46 in such a manner that brake shaft 46 cannot rotate past center. Brake bands 19 are centered over brake flange 20 by a system of rollers 66, 67 and 68 and pull-off springs 72. The brake centering system holds brake bands 19 off of flange 20 during operation of the drawworks and positions brake bands 19 to properly function when actuated by an operator.

Support brackets 76, 77, 78 and 79 are formed around the brake band 19 and flange 20 with an adjustable roller 66, 67 and 68 strategically placed around it. Pull-off springs 72 are provided at the live end of the brake band 19 and at the drum center line. When actuated, springs 72 pull brake band 19 back against rollers 66, 67 and 68 which are adjustable to hold brake band 19 approximately ⅛ inch off of flange 20.

Sand drum brake assembly 32 is constructed similarly to main drum brake assembly 31 except that brake assembly 32 does not require an equalizer assembly since it preferably uses only one brake 19.

It is apparent that innumerable variations of the preferred embodiments described hereinbefore may be utilized. However, these as well as other variations are believed to fall within the spirit and scope of the invention as covered by the claims attached herein.

What is claimed is:

1. A drawworks apparatus for raising and lowering items down a well bore, said drawworks comprising:

a frame having a working area within inner surfaces thereof where the raising and lowering of items occurs;

a main drum spool having at least a portion situated within said working area for raising and lowering items down the well bore via a length of cable wound thereon, said main drum spool extending through and rotatably mounted directly to said frame by a first set of bearings;

a main drum shaft rotatably and concentrically supported by said main drum spool in a manner in which said main drum shaft is isolated from wireline pull from said main drum spool imposed on said main drum spool during operation of said drawworks;

an auxiliary drum spool for raising and lowering items down a well bore via a length of cable wound thereon, said auxiliary drum spool rotatably supported by said frame by a second set of bearings;

an auxiliary drum shaft rotatably and concentrically supported by said auxiliary drum spool in a manner in which said auxiliary drum shaft is isolated from wireline pull from said auxiliary drum spool imposed on said auxiliary drum spool during operation of said drawworks;

a drive mechanism located outside of said working area for rotating said main drum spool and said auxiliary drum spool, said drive mechanism providing a driving force input through said auxiliary drum shaft via an input chain drive, said main drum spool having a clutch for engaging said drive mechanism located outside the working area and externally separated from said input chain drive; and a first brake assembly located outside of said working area, said first brake assembly being connected to said main drum spool so as to reduce the rate of rotation of said main drum spool during operation of said drawworks.

2. The drawworks apparatus of claim 1, further comprising a second brake assembly connected to said auxiliary drum spool for reducing the rate of rotation of said auxiliary drum spool, said second brake assembly being connected to said auxiliary drum spool.

3. The drawworks apparatus of claim 2, wherein said second brake assembly is connected to said auxiliary drum spool via a brake flange mounted outside the working area of said frame.

4. The drawworks apparatus of claim 3, wherein said second brake assembly comprises a second band brake.

5. The drawworks apparatus of claim 1, wherein said first brake assembly comprises a first band brake.

6. The drawworks apparatus of claim 5, wherein first said band brake is connected to said main drum spool via a pair of brake flanges mounted outside the working area of said frame.

7. The drawworks apparatus of claim 6, wherein said first band brake is configured for actuation via a level which applies an adjustable braking force sufficient to reduce the rate of rotation of said main drum spool.

8. The drawworks apparatus of claim 7, wherein said first band brake includes a brake band having at least one brake block mounted thereon, said brake band being connected to a rotatable brake shaft at a live end thereof via a first linkage assembly and to said frame at a dead end thereof via a second linkage assembly.

9. The drawworks apparatus of claim 8, wherein said first linkage assembly comprises a bracket and a link mechanism having a plurality of lugs thereon for connecting said bracket to said brake shaft in such a manner that prevents said brake shaft from rotating past center.

10. The drawworks apparatus of claim 9, wherein said second linkage assembly is adjustable and comprises a substantially tubular brake beam member which extends through and connected to said frame via a pair of anchors, a bell crank which is rotatably connected to each one of said anchors, and an equalizer system rotatably connected at one end to said bell crank and at another end to the dead end of said brake band.

11. The drawworks apparatus of claim 10, wherein said equalizer system comprises a threaded trunnion block sized for receipt by said bell crank, a trunnion pin having a drilled hole therein for receiving an equalizer screw, said trunnion pin being sized for receipt through respective concentric bored holes in said trunnion block and said bell crack, said drilled hole resulting in said trunnion pin being loaded in shear only.

12. The drawworks apparatus of claim 11, wherein said equalizer screw is rotatably manipulatable to adjust the linkage between said brake band and said second linkage system.

13. The drawworks apparatus of claim 1, wherein said drive mechanism comprises a chain drive mechanism.

14. The drawworks apparatus of claim 1, wherein said main drum shaft and said auxiliary drum shaft are rotatably mounted via bearings to said main drum spool and said auxiliary drum spool respectively.

15. The drawworks apparatus of claim 14, wherein said bearings comprise anti-friction bearings.

16. A drawworks apparatus comprising:

a frame which rotatably supports a drum spool, said drum spool supporting within an operating area of said frame where items are raised and lowered down a well bore a length of wire thereon for raising and lowering items down a well borg, said drum spool being mounted directly to said frame such that operational forces imposed upon said drum spool are transmitted directly to said frame;

a drive mechanism for rotating said main drum mechanism, said drive mechanism being located externally relative to said frame at a point outside of said operating area;

a band brake assembly positioned external to said frame and said operating area for reducing the rate of rotation of said main drum mechanism, said brake band assembly being connected at one end thereof to a rotatable brake shaft via a first linkage assembly and to said frame at a second end thereof via a second linkage assembly, wherein said first linkage assembly includes a bracket and link connection for connecting said bracket to said brake shaft in such a manner that prevents said brake shaft from rotating past center.

17. The drawworks apparatus of claim 16, wherein said second linkage assembly is adjustable and comprises a substantially tubular brake beam member which extends through and connected to said frame via a pair of anchors, a bell crank which is rotatably connected to each one of said anchors, and an equalizer system rotatably connected at one end to said bell crank and at another end to the dead end of said brake band assembly.

18. A drawworks apparatus comprising:

a frame which rotatably supports by direct connection a drum spool, said drum spool rotatably and concentrically supporting a drum shaft therein such that said drum shaft is isolated from wireline pull from said drum spool;

a drive mechanism connected to said drum shaft for driving said drum spool, said drive mechanism being positioned outside a working area of said frame where items are raised and lowered down a well bore;

a band brake assembly for reducing the rate of rotation of said drum spool, said band brake assembly being positioned outside of said working area and connected at one end thereof to a rotatable brake shaft via a first linkage assembly and to said frame at a second end thereof via an adjustable second linkage assembly, wherein said second linkage assembly comprises a substantially tubular brake beam member which extends through and connected to said frame via a pair of anchors, a bell crank which is rotatably connected to each one of said anchors, and an equalizer system rotatably connected at one end to said bell crank and at another end to the dead end of said band brake assembly.

19. The drawworks apparatus of claim 18, wherein said equalizer system comprises a threaded trunnion block sized for receipt by said bell crank, a trunnion pin having a drilled hole therein for receiving an equalizer screw, said trunnion pin being sized for receipt through respective concentric bored holes in said trunnion block and said bell crack, said drilled hole resulting in said trunnion pin being loaded in shear only.

20. The drawworks apparatus of claim 19, wherein said equalizer screw is rotatably manipulatable to adjust the linkage between said brake band assembly and said second linkage system.

* * * * *